US010801098B2

(12) United States Patent
Hanson et al.

(10) Patent No.: US 10,801,098 B2
(45) Date of Patent: Oct. 13, 2020

(54) ADAPTIVE ROBOTIC THERMAL SPRAY COATING CELL

(71) Applicant: GENERAL ELECTRIC COMPANY, Schenectady, NY (US)

(72) Inventors: Gerhart Hanson, Greenville, SC (US); Matthias Hoebel, Windisch (CH); Martin Lewis Smith, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 344 days.

(21) Appl. No.: 15/824,290

(22) Filed: Nov. 28, 2017

(65) Prior Publication Data

US 2019/0161844 A1 May 30, 2019

(51) Int. Cl.
*C23C 4/12* (2016.01)

(52) U.S. Cl.
CPC ..... *C23C 4/12* (2013.01)

(58) Field of Classification Search
None
See application file for complete search history.

(56) References Cited

U.S. PATENT DOCUMENTS 4,358,471 A 11/1982 Derkacs et al.
7,687,099 B2 3/2010 Jarvis
7,722,916 B2 5/2010 Wang et al.
8,214,663 B2 7/2012 Bosselmann et al.
8,217,663 B2 * 7/2012 Bosselmann ..... F01D 21/003 324/644
8,300,232 B2 10/2012 Sansom et al.
8,315,834 B2 11/2012 Gimelfarb et al.
8,988,668 B2 3/2015 Kurokawa et al.
2003/0087040 A1 5/2003 Ladentin
2005/0137829 A1 * 6/2005 Gimelfarb ..... G01B 11/0683 702/171
2007/0279645 A1 * 12/2007 Dratwinski ..... C23C 2/14 356/630
2007/0281074 A1 * 12/2007 Wang ..... B05B 12/00 427/8
2015/0216287 A1 8/2015 Matsushita

FOREIGN PATENT DOCUMENTS

JP 2012082455 A 4/2012
JP 20120082455 A 4/2012
JP 2014033949 A * 2/2014 ..... A45D 44/00

* cited by examiner

*Primary Examiner* — Michael P. Rodriguez
(74) *Attorney, Agent, or Firm* — McNees Wallace & Nurick LLC

(57) ABSTRACT

A method of coating a component using a robotic spray system is provided. The robotic spray system includes a scanning apparatus operable to measure and store surface characteristics before and after coating; a robotic arm operable to move the robotic spray system relative to a surface of a component, the component including one or more reference features which remains uncoated during the coating; a spray nozzle operable to deposit a sprayed coating onto the surface; and a device driver module including circuitry configured to operate the scanning apparatus, the robotic arm, and the spray nozzle.

15 Claims, 3 Drawing Sheets

ADAPTIVE ROBOTIC THERMAL SPRAY COATING CELL

FIELD OF THE INVENTION

The present disclosure is generally directed to a method of coating a component and a robotic spray system. More specifically, the present disclosure is directed to a method of coating a component using a robotic spray system and an adaptive robotic spray coating cell.

BACKGROUND OF THE INVENTION

In a variety of applications, a coating can be applied to one more surfaces of a component to protect it from the combined effects of high temperatures and oxidizing environment. In any coating process, it is essential to achieve correctly designed coating thickness. Too thin of a coating may not provide adequate protection from harsh conditions; conversely, too thick of a coating may result in adherence problems between the coating itself and the underlying substrate.

Accordingly, a number of techniques have been developed for measuring the thickness of a coating applied to a component. For example, micrometers can be used to measure the distance between two points of contact between the micrometer and a component's surface. Another known method involves measuring variations in magnetic field or in impedance of Eddy current inducting coils caused by coating thickness variations. These methods can work in certain instances, but they lack the versatility to maintain their accuracy in connection with certain coatings processes and/or components with complex geometries such as fillets on a turbine engine blade or vane.

BRIEF SUMMARY OF THE INVENTION

In an exemplary embodiment, a method of coating a component using a robotic spray system is provided. The robotic spray system includes a scanning apparatus operable to measure and store surface characteristics, a robotic arm operable to move the robotic spray system relative to a surface of the component, and a spray nozzle operable to deposit a sprayed coating onto the surface. The method includes measuring and storing the surface characteristics of the component with the scanning apparatus and generating a three-dimensional pre-coat coating profile; coating the component with the spray nozzle to form a coated component; measuring and storing the surface characteristics of the coated component with the scanning apparatus and generating a three-dimensional post-coat coating profile; generating a three-dimensional coating thickness map by in response to the pre-coat coating profile, the post-coat coating profile and a deformation compensation factor, the coating thickness map displaying coating thickness across the component; determining a three-dimensional recoat profile in response to the coating thickness map and the reference deposition profile, the recoat profile including a recoat area and an additional coating thickness; and coating a portion of the component with the spray nozzle based on the recoat profile. The component includes one or more reference features which remain uncoated during the coating. The deformation compensation factor is determined by adding internal deformations and external deformations, wherein the internal deformations are determined by comparing the post-coating profile in a hot condition after the coating has finished and in a cold condition after the component has cooled to ambient temperature and the external deformations are determined by comparing the reference features before and after the coating with the scanning apparatus.

In another exemplary embodiment, a robotic spray system is provided. The robotic spray system includes a scanning apparatus operable to measure and store surface characteristics before and after coating; a robotic arm operable to move the robotic spray system relative to a surface of a component; a spray nozzle operable to deposit a sprayed coating onto the surface; and a device driver module including circuitry configured to operate the robotic arm and the spray nozzle. The component includes one or more reference features which remain uncoated during the coating.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Provided are exemplary methods of coating a component using a robotic spray system and a robotic spray system. Embodiments of the present disclosure, in comparison to components and method not utilizing one or more features disclosed herein, enable a decrease in strip and recoat of parts that were not coated to spec, specifically those that are under dimension. It would also give our operators feedback as to issues with a robotic spray system and help us tune in the coating operation.

All numbers expressing quantities of ingredients and/or reaction conditions are to be understood as being modified in all instances by the term "about", unless otherwise indicated.

All percentages and ratios are calculated by weight unless otherwise indicated. All percentages are calculated based on the total weight of a composition unless otherwise indicated. All component or composition levels are in reference to the active level of that component or composition, and are exclusive of impurities, for example, residual solvents or by-products, which may be present in commercially available sources.

The articles "a" and "an," as used herein, mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

The term "at least one," as used herein, means one or more and thus includes individual components as well as mixtures/combinations.

The term "comprising" (and its grammatical variations), as used herein, is used in the inclusive sense of "having" or "including" and not in the exclusive sense of "consisting only of."

Figure 1:
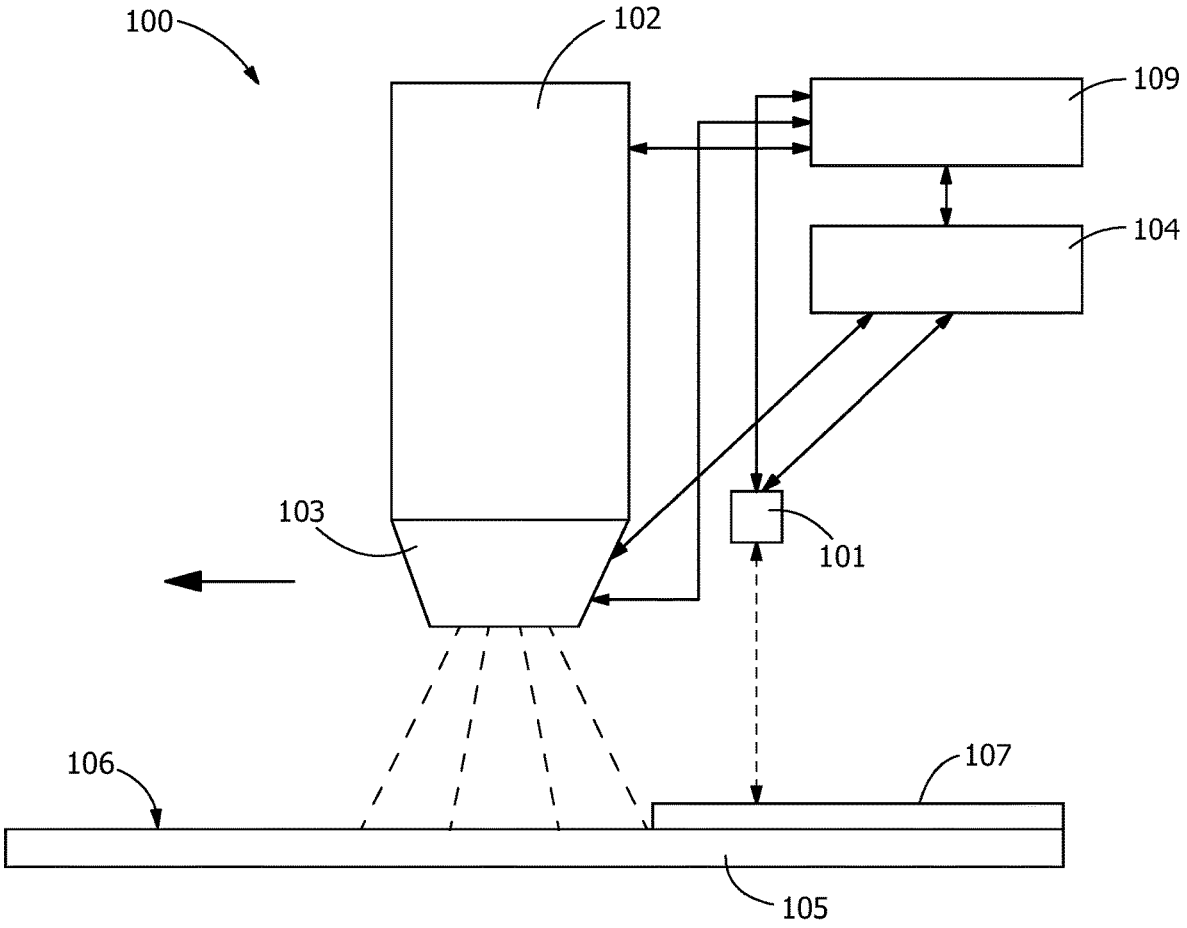
FIG. 1 shows a section view of an exemplary robotic spray system depositing a sprayed coating onto a surface of a component, according to an exemplary embodiment of the disclosure.

With reference to FIG. 1, a robotic spray system 100 is provided. Robotic spray system 100 includes a scanning apparatus 101, a robotic arm 102, a spray nozzle 103, a mapping module 104 and a device driver module 109. Scanning apparatus 101 is operable to measure and store surface characteristics before and after coating. Robotic arm 102 is operable to move robotic spray system 100 in a direction relative to a surface 106 of a component 105. The surface 106 includes one or more reference features which remain uncoated during the coating. Spray nozzle 103 is operable to deposit a sprayed coating 107 onto surface 106. Device driver module 109 includes circuitry configured to operate scanning apparatus 101, the robotic arm 102, and the spray nozzle 103. A person skilled in the art will appreciate that the present invention may be used with any suitable component.

In some embodiments, scanning apparatus 101 is directly secured to robotic arm 102. In another embodiment, scanning apparatus 101 is attached to robotic arm 102 through a fixture. In another embodiment, scanning apparatus 101 is not secured/attached to robotic arm and move independently from robotic arm 102. In some embodiments, robotic spray system 100 includes more than one scanning apparatus 101.

The scanning apparatus 101 may actively scan the component surface 106 using various techniques including sonic techniques such as ultrasound, optical techniques including reflectance, and/or diffraction of visible light, and other techniques including radio waves, microwaves, infra-red, ultraviolet radiation, and combinations thereof. The mapping module 104 receives the data from the scanning apparatus 101 and analyzes the data to construct a contour map of the surface 106.

The mapping module 104 may additionally determine parameters for the deposition of the coating 107, based on coating characteristics provided by a user. The deposition parameters may be communicated to the driver module 109. The driver module 109 may then control the movement of the robotic arm 102 and deposition of coating materials via nozzle 103 to form the coating 107.

The scanning apparatus 101 may also actively scan the deposited coating 107 and communicate the data to the mapping module 104. A contour map of the deposited coating 107 may be determined by the mapping module 104 to verify the coating 107 is within the desired parameters. If the coating 107 is not within the desired parameters, the driver module 109 may instruct the spray system 100 to deposit additional material in one or more selected regions until the coating 107 conforms to the user's desired characteristics.

If the mapping module 104 determines the deposited coating 107 is overly thick in one or more regions, the mapping module 104 may communicate the error externally to the spray system 100, such as to a user or removal apparatus. In some embodiments, a user may then remove at least a portion of the deposited coating 107. In one embodiment, the user may apply a chemical etching solution to one or more regions of the coating 107. In some embodiments, an automated apparatus, such as a laser, may be used to ablate portions of the coating 107. The treated regions may then be re-scanned by the scanning apparatus 101 and further coating deposition may be provided if needed.

Figure 2:
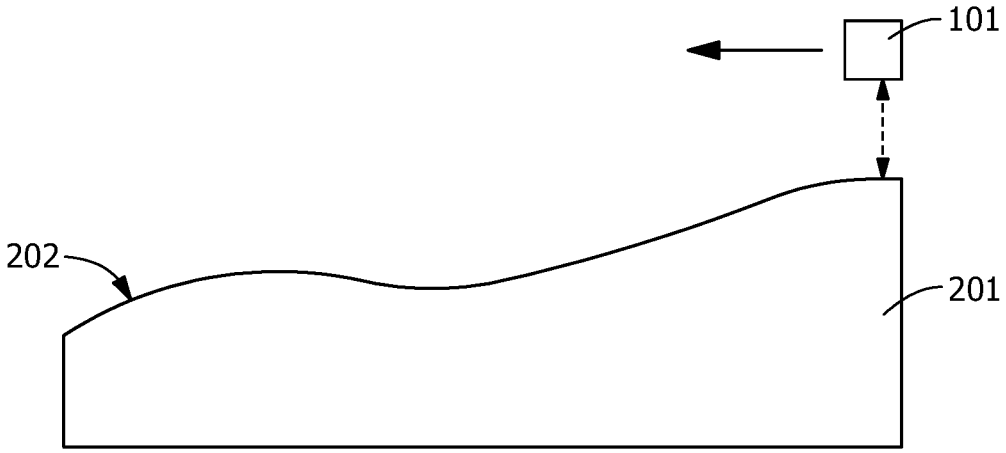
FIG. 2 shows a section view of a component before coating, according to an exemplary embodiment of the disclosure.
Figure 3:
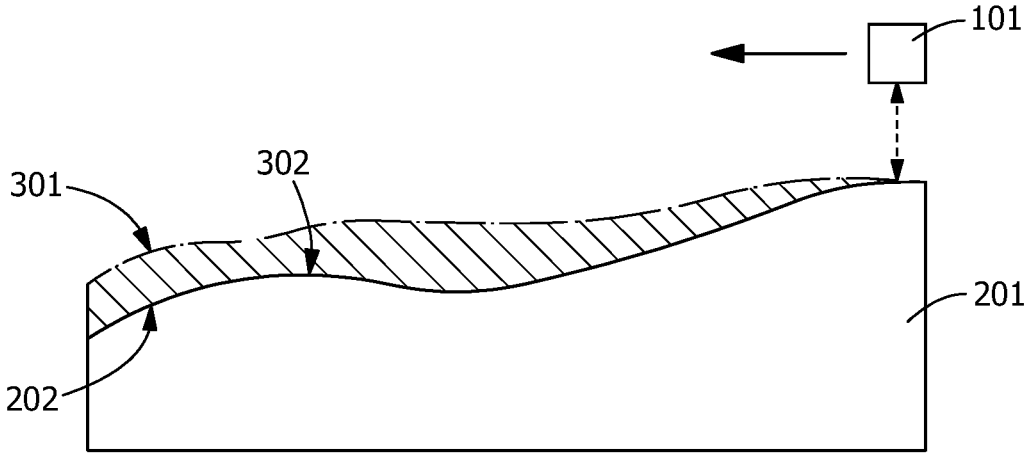
FIG. 3 shows a section view of a component after coating, according to an exemplary embodiment of the disclosure.

With reference to FIG. 2, scanning apparatus 101 measures and stores surface characteristics before coating as it moves in a direction 203. Before any spraying occurs, scanning apparatus 101 scans a surface 202 of a component 201 to generate a three-dimensional pre-coat coating profile. The term "pre-coat coating profile", as used herein, refers to a surface profile across the component including thickness, reflectivity, roughness and magnetic pattern before the coating process starts. With reference to FIG. 3, scanning apparatus 101 measures and stores surface characteristics after coating as it moves above a surface 301. Upon completion of spraying, scanning apparatus 101 scans surface 301 of component 201 to generate a three-dimensional post-coat coating profile. The surface 301 includes one or more reference features (not shown in FIGS. 2-4), the reference features which remain uncoated during the coating process. The term "post-coat coating profile", as used herein, refers to a surface profile across the component including thickness after the coating process ends. Scanning apparatus 101 further compares the one or more reference features before and after the coating and send signals including information about the reference features to mapping module 104 to calculate or determine a deformation compensation factor encompassing all possible deformations including internal deformations such as thermal expansion and thermal distortion and external deformations such as part distortion, translation/tilt due to hot fixtures holding the component. "Internal deformations", used herein, means any deformation originating from the component itself. "External deformations", used herein, means any deformation originating from outside the component. Any translation/tilt of the component resulting from thermal effects in the fixture and in the coating cell will be included in the deformation compensation factor to compensate for noticeable displacements. For example, high-velocity oxygen fuel (HVOF) spraying may show peening effects which leads to a mechanical distortion of the component. Deformation/distortion could also result from shrinkage forces after deposition of multiple coating passes.

In some embodiments, one or more reference features are easily detectable and non-changing on uncoated areas of the component. CCS (component coordinate system) is derived from the reference features. These datum positions are used to compare the part in uncoated, coated/hot and coated/cold conditions to examine any variation in location. The reference features may include multiple datum positions engraved by laser, multiple datum positions derived from the intersection of sealing grooves, multiple datum positions derived from the intersection of three planes or combinations thereof. With 3 reference features (3 datum points), a precise reference coordinate system can be created. One datum point is the origin of the CCS, and the connecting vector to the other 2 datum points are used to precisely define the x- and y-axis of the CCS. The 3rd axis is calculated as the vector product of x- and y-axis. In other embodiments, the reference features can be added to the component, for example, by integrating features. Using the reference features, it is guaranteed that the exact same position on the component is measured at all times before and after the coating without potential misalignments, thereby allow more accurate determination of thermal deformation factor and a compensation of potential movement of the part in the fixture. A person skilled in the art will appreciate that the directions 203 and 303 can be any direction.

The deformation compensation factor is ultimately determined by adding internal deformations and external deformations, wherein the internal deformations are determined by comparing the post-coating profile in a hot condition after the coating has finished and in a cold condition after the component has cooled to ambient temperature and the external deformations are determined by comparing the reference features before and after the coating with the scanning apparatus.

Scanning apparatus 101 may be selected from an IR temperature monitoring device, a photogrammetric 3D (blue light) scanner, triangulation sensor, white light interferometer, conoprobe or combinations thereof. Using an IR camera or pyrometer, more accurate compensation of the thermal expansion/deformation for the development of multiple deformation compensation factors due to the possible variations of final temperature after coating, which the enables more accurate measurement of coating thickness. With the development of multiple deformation compensation factor profiles at various final component temperatures, it is possible choose a deformation compensation factor profile that most accurately calculates the overall coating thickness of the coated components. Using a photogrammetric 3D scanner, establishing more accurate three-dimensional profiles/models in cold (pre-coating) condition and hot (post-coating) condition is possible. In some embodiments, the photogrammetric 3D scanner projects a pattern onto the component using light, where the pattern may range from a single point to full illumination, or any variation in between these two extremes. For example, the pattern may be a series of segment. The pattern may also comprise complete illumination as well, for example, where the number of segments is so large that they effectively coalesce. The one or more imaging portions observe the projected pattern on the object, and deduce the 3D information on the object, preferably using triangulation techniques. Using a photogrammetric scanner, it is possible develop a highly accurate 3d model of the component and generate a three-dimensional pre-coating profile, a three-dimensional post-coating profile and deformation compensation factor across the entire component regardless of component geometry complexity is completed. In some embodiments, a deformation compensation factor is determined or calculated by pre-calibration scans before any coating using aforementioned scanning/monitoring devices in a development setting. The pre-calibration scans can be performed one time, or multiple times in some instances. When performed multiple times, they can be averaged to provide an average deformation compensation factor in some instances. It is critical to make the condition of pre-calibration to be comparable or identical to the condition of actual coating. In some embodiment, the pre-calibration scans are completed in the hot condition after coating has finished and then again in the cold condition (once the component has cooled to ambient temperature). An overlaying of the two scans (hot and cold) allows for derivation of a deformation compensation factor across the entire component, which is important because this factor varies across the component at various locations given varying thermal expansion and distortion characteristics. This then lends to generating very accurate thickness calculations across the entire component. In some embodiments, the hot condition may be in the range of from 400° F. to 1400° F. The determined or calculated deformation compensation factor will later be used to generate a three-dimensional coating thickness map. In some embodiments, the deformation compensation factor can be adjusted after each coating depending on additional deformation occurring during the coating.

Figure 4:
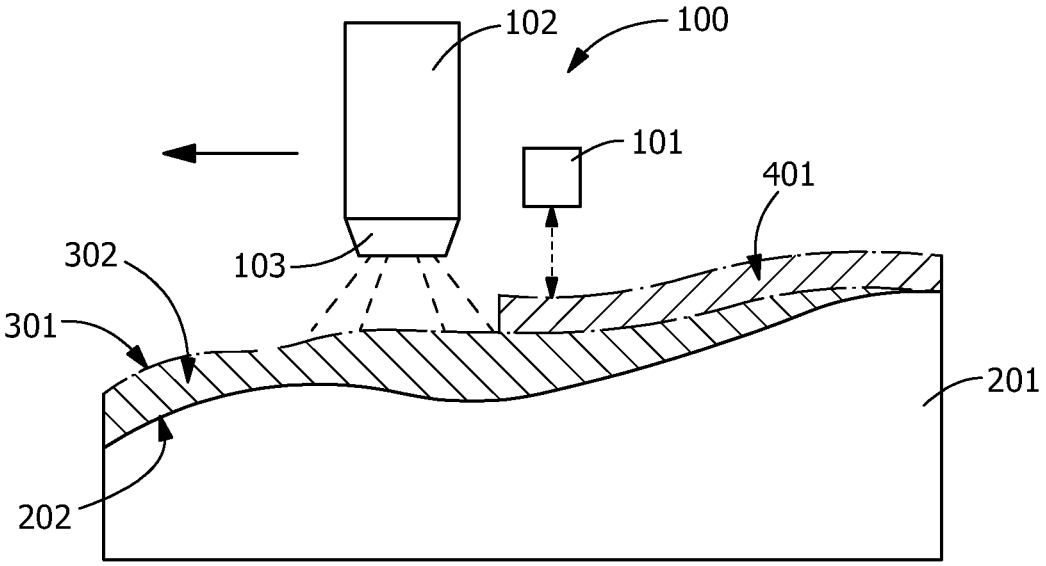
FIG. 4 shows a section view of a component after additional coating, according to an exemplary embodiment of the disclosure.

In some embodiments, mapping module 104 including circuitry configured to calculate or determine a deformation compensation factor, generate a three-dimensional coating thickness map 302 in response to the pre-coat coating profile, the post-coat coating profile and the deformation compensation factor. The term "coating thickness map", as used herein, refers to a coating profile across the coating including thickness pattern. In some embodiments, coating thickness map 302 is obtained by subtracting the pre-coat coating profile from the post-coat coating profile and adding the deformation compensation factor. The deformation compensation factor can be positive or negative depending on deformations during the process. Mapping module 104 may further include software(s) to perform the comparison to interpret the thickness map across the component and send signals back to device driver module 109 which would then deposit additional coating to needed locations. Coating thickness map 302 displays coating thickness across component 201. With reference to FIG. 4, the circuitry further determines a three-dimensional recoat profile 401 in response to coating thickness map 302 and a reference deposition profile (not shown in FIG. 4). In some embodiments, recoat profile 401 is obtained by subtracting coating thickness map 302 from the reference deposition profile and calculating/determining a recoat area and an additional coating thickness. The recoat area may cover entire or partial surface 301 of component 201. Robotic spray system deposits an additional sprayed coating onto surface 301 in response to recoat profile 401 as it moves in a direction 402. A person skilled in the art will appreciate that the direction 402 can be any direction. In some embodiments, device driver module 109 controls spray nozzle 103 to selectively coat the portion of the component does not affect other portions wherein the additional coating thickness is not desired.

In some embodiments, device driver module 109 is configured to control the robotic spray system 100 and communicates with the mapping module 104. For example, device driver module 109 receives recoat profile 401 from mapping module 104, moves robotic arm 102 to move the robotic spray system 100 and controls spray nozzle 103 to coat a portion of the component in response to recoat profile 401.

In some embodiments, scanning apparatus 101, robotic arm 102 and spray nozzle 103 electronically communicate with mapping module 104 and device driver module 109.

In some embodiments, the surface characteristics may include, but not be limited to, a coating thickness, surface roughness and surface temperature. A person skilled in the art will appreciate any suitable surface characteristics to complete accurate spraying across the component.

In one embodiment, the component is a hot gas path component. In another embodiment, the component is a turbine component including, but not limited to, blades (buckets), vanes (nozzles), shrouds, combustors, transition ducts, or combinations thereof. In another embodiment, the coated component is a gas turbine component. In another embodiment, the component is a non-turbine component. A person skilled in the art will appreciate that the present invention may be used with any suitable component.

In some embodiments, the component includes a flat surface. In other embodiments, the component includes a curved surface. In other embodiments, the component includes both a flat surface and a curved surface.

Figure 5:
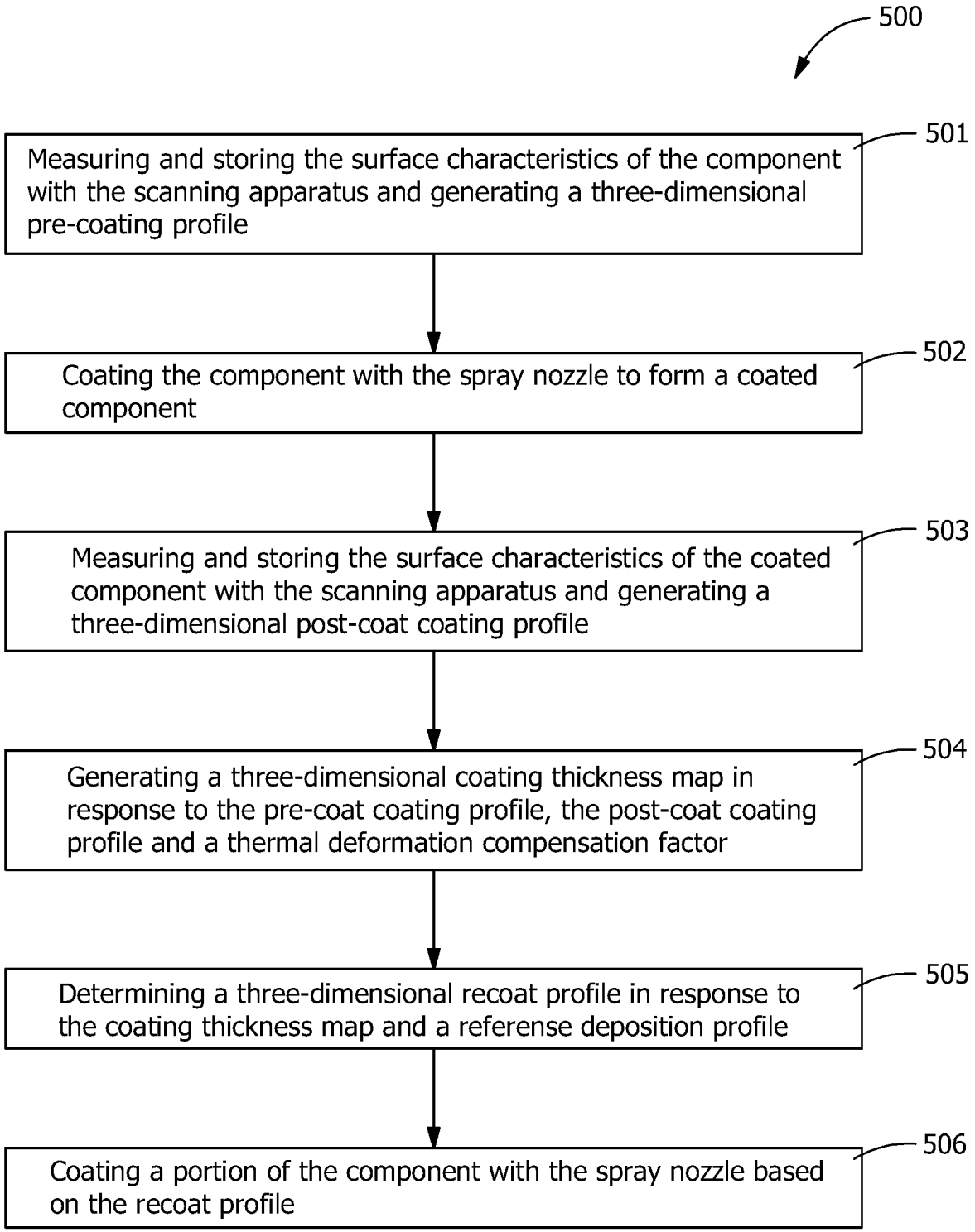
FIG. 5 shows a flow chart of an exemplary method of coating a component, according to an exemplary embodiment of the disclosure.

With reference to FIG. 5, shows a flow chart of an exemplary method 500 of coating a component using a robotic spray system is provided. The method comprises measuring and storing the surface characteristics of the component with the scanning apparatus and generating a three-dimensional pre-coat coating profile (step 501); coating the component with the spray nozzle to form a coated component (step 502); measuring and storing the surface characteristics of the coated component with the scanning apparatus and generating a three-dimensional post-coat coating profile (step 503); generating a three-dimensional coating thickness map in response to the pre-coat coating profile, the post-coat coating profile and a deformation compensation factor, the coating thickness map displaying coating thickness across the component (step 504); determining a three-dimensional recoat profile in response to the coating thickness map and a reference deposition profile, the recoat profile including a recoat area and an additional coating thickness (step 505); and coating a portion of the component with the spray nozzle based on the recoat profile (step 506).

In some embodiments, mapping module compares the coating thickness map with the reference deposition profile across the component to determine the recoat profile. The reference deposition profile may be a predetermined thickness. In some embodiments, scanning apparatus has a window of about, for example, 10, 20 or 30 seconds to scan the coated component, compare the target area before and after the coating, and compare the pre-coat coating profile with the post-coat coating profile. The quick scanning while the component is still hot allows for proper coating adhesion without any preheating of the component. A person skilled in the art will appreciate that the window may vary depending on the thermal spray process being used and material being applied. In some embodiments, the reference deposition profile is manually and/or automatically input to mapping module.

In one embodiment, the pre-coat coating profile and post-coat coating profile are fully continuous. In another embodiment, the pre-coat coating profile and post-coat coating profile are partially continuous. In another embodiment, the pre-coat coating profile and post-coat coating profile comprise discrete points.

In some embodiments, coating the component is applied by one or more thermal spraying techniques. In some embodiments, the thermal spraying technique is high-velocity oxygen fuel (HVOF) spraying, vacuum plasma spraying (VPS), high-velocity air-fuel (HVAF) spraying, wire arc spraying, flame/combustion spraying, air plasma spraying (APS) or any combinations thereof. The thermal spraying technique preferably heats the overlay material to a temperature of at least 1900° C. (3450° F.), alternatively to at least 2000° C. (3650° F.). In some embodiments, the HVOF spraying technique heats the overlay material to the range of about 2750° C. to about 3600° C. (5000-6500° F.), alternatively about 2750° C. to about 3300° C. (5000-6000° F.), alternatively about 2750° C. to about 3050° C. (5000-5500° F.), alternatively about 3050° C. to about 3300° C. (5500-6000° F.), alternatively about 3300° C. to about 3600° C. (6000-6500° F.), or any suitable combination, sub-combination, range, or sub-range thereof. In some embodiments, the HVAF spraying technique heats the overlay material to the range of about 1900° C. to about 2000° C. (3450-3550° F.), alternatively about 1900° C. to about 1950° C. (3450-3550° F.), alternatively about 1950° C. to about 2000° C. (3550-3650° F.), or any suitable combination, sub-combination, range, or sub-range thereof.

In some embodiments, the method further comprises spraying experimental test plates and/or actual development components to pre-calibrate a relation between a number of coating passes and coating thickness before any coating. In some embodiments, the method further comprises repeating the steps above to obtain the reference deposition profile across the component.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of coating a component using a robotic spray system including a scanning apparatus operable to measure and store surface characteristics, a robotic arm operable to move the robotic spray system relative to a surface of the component, and a spray nozzle operable to deposit a sprayed coating onto the surface, the method comprising:

measuring and storing the surface characteristics of the component with the scanning apparatus and generating a three-dimensional pre-coat coating profile;

coating the component with the spray nozzle to form a coated component while the component is in a hot condition;

measuring and storing the surface characteristics of the coated component with the scanning apparatus and generating a three-dimensional post-coat coating profile while the component is still in the hot condition;

generating a three-dimensional coating thickness map in response to the pre-coat coating profile, the post-coat coating profile and a deformation compensation factor while the component is still in the hot condition, the coating thickness map displaying a coating thickness across the component;

determining a three-dimensional recoat profile in response to the coating thickness map and a reference deposition profile while the component is still in the hot condition, the recoat profile including a recoat area and an additional coating thickness; and coating a portion of the component with the spray nozzle based on the recoat profile while the component is still in the hot condition, wherein the component includes one or more reference features which remain uncoated during the coating, and wherein the deformation compensation factor is a pre-calculated factor determined by adding internal deformations and external deformations of a development component, the internal deformations having been determined by comparing the post-coating profile of the development component in a hot condition after a development coating has finished and in a cold condition after the development component has cooled to ambient temperature and the external deformations having been determined by comparing development reference features of the development component before and after the development coating with a development scanning apparatus.

2. The method of claim 1, wherein the coating thickness map is generated by subtracting the pre-coat coating profile from the post-coat coating profile and adding the deformation compensation factor.

3. The method of claim 1, wherein the recoat profile is determined by subtracting coating thickness map from the reference deposition profile.

4. The method of claim 1, further providing a mapping module including circuitry configured to generate the coating thickness map in response to the pre-coat coating profile, the post-coat coating profile and the deformation compensation factor; and determine the recoat profile in response to the coating thickness map and the reference deposition profile.

5. The method of claim 4, further providing a device driver module including circuitry to operate the robotic arm and the spray nozzle.

6. The method of claim 5, wherein the device driver module receives the recoat profile from the mapping module, moves the robotic arm to move the robotic spray system and controls the spray nozzle to coat the portion of the component in response to the recoat profile.

7. The method of claim 5, wherein the device driver module controls the robotic spray system and communicates with the mapping module.

8. The method of claim 1, wherein the deformation compensation factor includes mechanical distortion, translation, tilt, thermal expansion, and thermal distortion.

9. The method of claim 1, further comprising spraying experimental test plates and actual development components to pre-calibrate a relation between a number of coating passes and a coating thickness.

10. The method of claim 1, wherein the operating the spray nozzle to coat the portion of the component does not affect other portions wherein the additional coating thickness is not desired.

11. The method of claim 1, wherein the surface characteristics include a coating thickness and surface temperature.

12. The method of claim 1, wherein the hot condition is in the range from 400° F. to 1,400° F.

13. The method of claim 1, wherein the scanning apparatus determines the three-dimensional recoat profile within 30 seconds after the coating of the component to form the coated component.

14. The method of claim 1, wherein the component is a hot gas path turbine component.

15. The method of claim 14, wherein the hot gas path turbine component is selected from the group consisting of buckets, nozzles, shrouds combustors, transition ducts, and combinations thereof.

* * * * *